US008543028B2

(12) United States Patent
Kimura et al.

(10) Patent No.: US 8,543,028 B2
(45) Date of Patent: Sep. 24, 2013

(54) MAINTENANCE SYSTEM, CLEANING SYSTEM, AND IMAGE FORMING APPARATUS

(75) Inventors: Akiko Kimura, Kanagawa (JP); Tomoya Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 333 days.

(21) Appl. No.: 13/008,315

(22) Filed: Jan. 18, 2011

(65) Prior Publication Data

US 2011/0318034 A1 Dec. 29, 2011

(30) Foreign Application Priority Data

Jun. 23, 2010 (JP) ..... 2010-142932

(51) Int. Cl.
*G03G 15/02* (2006.01)

(52) U.S. Cl.
USPC ..... 399/100; 399/71

(58) Field of Classification Search
USPC ..... 399/9, 14, 91, 98–101, 71
See application file for complete search history.

(56) References Cited

U.S. PATENT DOCUMENTS

2010/0061744 A1* 3/2010 Kim ..... 399/43
2010/0278548 A1* 11/2010 Burry et al. ..... 399/49

FOREIGN PATENT DOCUMENTS

JP 10-003203 1/1998
JP 2004-109394 4/2004

* cited by examiner

*Primary Examiner* — Hoan Tran
(74) *Attorney, Agent, or Firm* — Sughrue Mion, PLLC

(57) ABSTRACT

A maintenance system includes a maintenance device and a control device that controls the operation of the maintenance device. The control device is configured to activate the maintenance device automatically when a numerical value associated with the operation of a maintenance target device reaches a predetermined threshold value and to activate the maintenance device when it receives an instruction from a user. When the control device is instructed to activate the maintenance device by an instruction from the user, the control device changes the preset threshold value such that the operation interval of the maintenance device becomes smaller.

10 Claims, 9 Drawing Sheets

| | CUMULATIVE IMAGE DENSITY | IMAGE HOLDER NUMBER-OF-ROTATIONS | CUMULATIVE NUMBER OF PRINTS | CHARGING TIME | SITTING TIME |
|---|---|---|---|---|---|
| PRESET THRESHOLD VALUE | 1000 | 1000 | 1000 | 1000 | 1000 |
| NUMBER OF TIMES THIS THRESHOLD VALUE HAS BEEN REACHED | 5 | 2 | 1 | 1 | 1 |
| THRESHOLD VALUE AFTER BEING CHANGED | 900 | 900 | 900 | 900 | 900 |

FIG. 3

| | CUMULATIVE IMAGE DENSITY | IMAGE HOLDER NUMBER-OF-ROTATIONS | CUMULATIVE NUMBER OF PRINTS | CHARGING TIME | SITTING TIME |
|---|---|---|---|---|---|
| PRESET THRESHOLD VALUE | 1000 | 1000 | 1000 | 1000 | 1000 |
| NUMBER OF TIMES THIS THRESHOLD VALUE HAS BEEN REACHED | 5 | 2 | 1 | 1 | 1 |
| THRESHOLD VALUE AFTER BEING CHANGED | 900 | 900 | 900 | 900 | 900 |

FIG. 8

| | CUMULATIVE IMAGE DENSITY | IMAGE HOLDER NUMBER-OF-ROTATIONS | CUMULATIVE NUMBER OF PRINTS | CHARGING TIME | SITTING TIME |
|---|---|---|---|---|---|
| PRESET THRESHOLD VALUE | 1000 | 1000 | 1000 | 1000 | 1000 |
| NUMBER OF TIMES THIS THRESHOLD VALUE HAS BEEN REACHED | 5 | 2 | 1 | 1 | 1 |
| THRESHOLD VALUE AFTER BEING CHANGED | 950 | 980 | 990 | 990 | 990 |

FIG. 9

| | CUMULATIVE IMAGE DENSITY | IMAGE HOLDER NUMBER-OF-ROTATIONS | CUMULATIVE NUMBER OF PRINTS | CHARGING TIME | SITTING TIME |
|---|---|---|---|---|---|
| PRESET THRESHOLD VALUE | 1000 | 1000 | 1000 | 1000 | 1000 |
| NUMBER OF TIMES THIS THRESHOLD VALUE HAS BEEN REACHED | 5 | 2 | 1 | 1 | 1 |
| THRESHOLD VALUE AFTER BEING CHANGED | 900 | 900 | 1000 | 1000 | 1000 |

MAINTENANCE SYSTEM, CLEANING SYSTEM, AND IMAGE FORMING APPARATUS

CROSS-REFERENCE TO RELATED APPLICATION

This application is based on and claims priority under 35 USC 119 from Japanese Patent Application No. 2010-142932 filed on Jun. 23, 2010.

BACKGROUND

Technical Field

The present invention relates to a maintenance system, a cleaning system, and an image forming apparatus.

SUMMARY

A maintenance system pertaining to a first aspect of the present invention includes: a maintenance device; and a control device that controls the operation of the maintenance device, wherein the control device is configured to activate the maintenance device automatically when a numerical value associated with the operation of a maintenance target device reaches a predetermined threshold value and to activate the maintenance device when it receives an instruction from a user, wherein when the control device is instructed to activate the maintenance device by an instruction from the user, the control device changes the preset threshold value such that the operation interval of the maintenance device becomes smaller.

BRIEF DESCRIPTION OF THE DRAWINGS

Exemplary embodiments of the present invention will be described in detail based on the following figures, wherein:

FIG. 3 is a table showing threshold values of parameters used in the cleaning system pertaining to the first exemplary embodiment of the present invention;

FIG. 8 is a table showing threshold values of parameters used in the cleaning system pertaining to the second exemplary embodiment of the present invention; and FIG. 9 is a table showing threshold values of parameters used in a cleaning system pertaining to a third exemplary embodiment of the present invention.

DETAILED DESCRIPTION

A cleaning system and an image forming apparatus of a first exemplary embodiment of the present invention will be described in accordance with FIG. 1 to FIG. 6.

Figure 6:
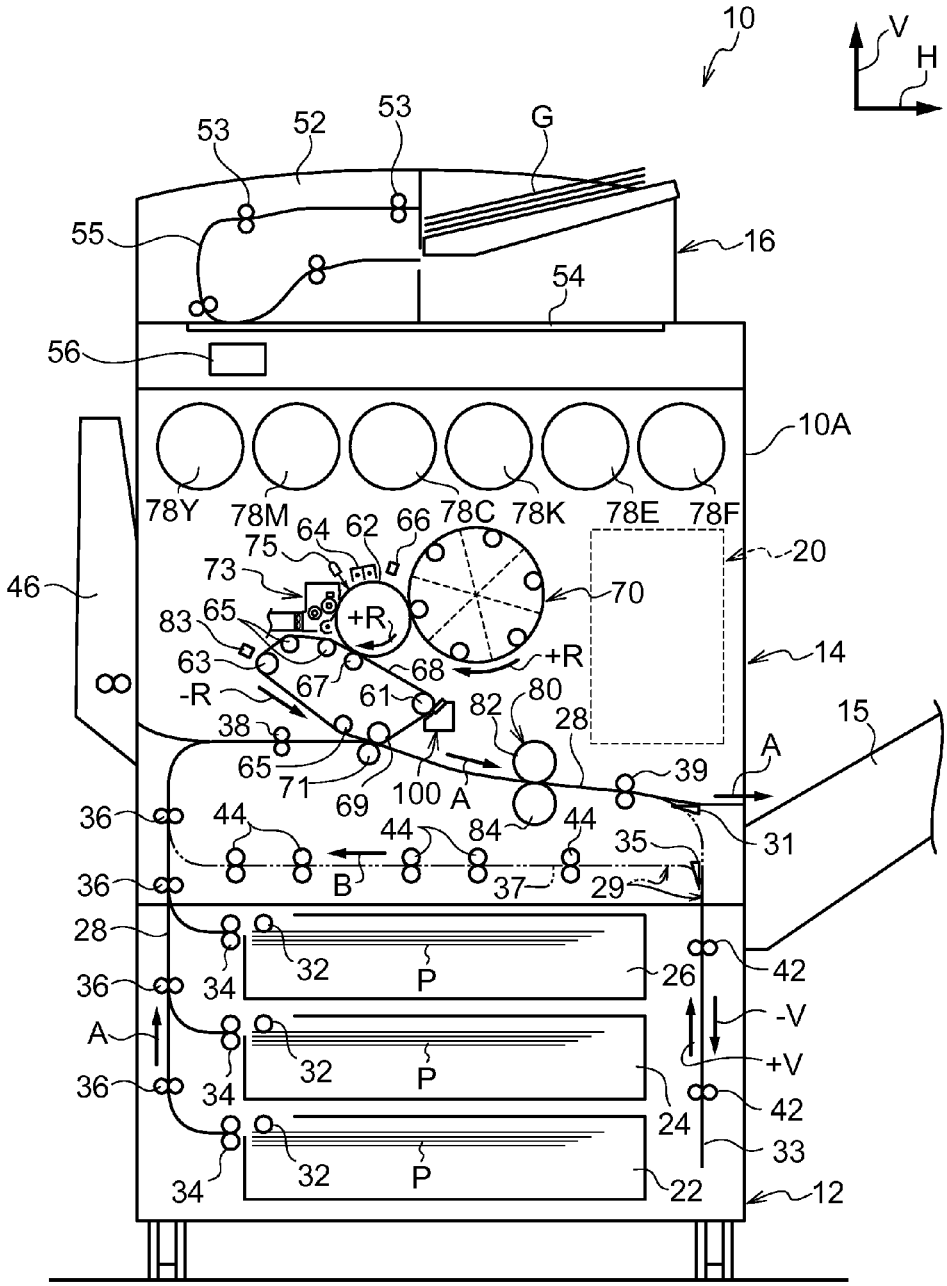
FIG. 6 is a general configuration diagram showing an image forming apparatus pertaining to the first exemplary embodiment of the present invention.

As shown in FIG. 6, an image forming apparatus 10 pertaining to the present exemplary embodiment is, proceeding from its lower side to its upper side in the vertical direction (the direction of arrow V), configured to include a housing section 12 in which sheet members P serving as a recording medium are housed, an image forming section 14 that is disposed above the housing section 12 and performs image formation on the sheet members P supplied from the housing section 12, a document reading section 16 that is disposed above the image forming section 14 and reads reading documents G, and a controller 20 that is disposed inside the image forming section 14 and controls the working of each part of the image forming apparatus 10. In the following description, the vertical direction (the direction of arrow V) of an apparatus body 10A of the image forming apparatus 10 will simply be called "the vertical direction", and the horizontal direction (the direction of arrow H shown in FIG. 6) of the apparatus body 10A of the image forming apparatus 10 will simply be called "the horizontal direction".

In the housing section 12, there are disposed a first housing unit 22, a second housing unit 24, and a third housing unit 26 in which the sheet members P of different sizes are housed. Moreover, in the first housing unit 22, the second housing unit 24, and the third housing unit 26, there are disposed feed rolls 32 that feed the housed sheet members P to a conveyance path 28 disposed inside the image forming apparatus 10. Additionally, on the downstream side of the feed rolls 32 in the conveyance direction of the sheet members P in the conveyance path 28 (hereinafter simply called "the conveyance direction downstream side"), there are disposed conveyance rolls 34 and conveyance rolls 36 that convey the sheet members P one at a time. Further, on the conveyance direction downstream side of the conveyance rolls 36 in the conveyance path 28, there are disposed alignment rolls 38 that temporarily stop the sheet member P and feed the sheet member P at a determined timing to a later-described secondary transfer position.

Moreover, the downstream side portion of the conveyance path 28 disposed on the underside of the image forming section 14 is disposed so as to extend from the left side portion of the image forming section 14 to a paper discharge unit 15 disposed on the right side surface of the image forming section 14 when seen from the front of the image forming apparatus 10. Further, a two-sided (duplex printing) conveyance path 29 on which the sheet member P is conveyed and inverted in order to perform image formation on both sides of the sheet member P is connected to the conveyance path 28.

This two-sided conveyance path 29 has, when seen from the front of the image forming apparatus 10, a first switching member 31 where switching between the conveyance path 28 and the two-sided conveyance path 29 is performed, an inversion portion 33 that is disposed so as to extend linearly in the vertical direction from the lower right side portion of the image forming section 14 to the right side of the housing section 12, a conveyance portion 37 into which the trailing end of the sheet member P conveyed to the inversion portion 33 enters and on which the sheet member P is horizontally conveyed, and a second switching member 35 where switching between the inversion portion 33 and the conveyance portion 37 is performed. Additionally, conveyance rolls 42 are disposed at multiple places an interval apart from each other in the inversion portion 33, and conveyance rolls 44 are disposed at multiple places an interval apart from each other in the conveyance portion 37.

This first switching member 31 is a cross-sectionally triangular prism-shaped member whose distal end portion is moved by unillustrated driving means to either one of the conveyance path 28 or the two-sided conveyance path 29 to thereby switch the conveyance direction of the sheet member P. Similarly, the second switching member 32 is a cross-sectionally triangular prism-shaped member whose distal end portion is moved by unillustrated driving means to either one of the inversion portion 33 or the conveyance portion 37 to thereby switch the conveyance direction of the sheet member P.

The conveyance direction downstream side end portion of the conveyance portion 37 is connected to the conveyance path 28 by an unillustrated guide member. Further, on a wall surface on the left side of the image forming section 14, there is disposed a foldaway manual paper supply unit 46, and the manual paper supply unit 46 is connected in front of the alignment rolls 38 on the conveyance path 28.

In the document reading section 16 disposed on the upper side of the image forming apparatus 10, there are disposed a document conveying device 52 that automatically conveys the reading documents G one at a time, a platen glass 54 that is placed on the underside of the document conveying device 52 and on which one of the reading documents G is placed, and a document reading device 56 that reads the reading documents G conveyed by the document conveying device 52 and the reading document G placed on the platen glass 54.

This document conveying device 52 has an automatic conveyance path 55 on which multiple conveyance rolls 53 are placed, and part of the automatic conveyance path 55 is placed such that the reading documents G pass over the platen glass 54. Further, the document reading device 56 is configured to read the reading documents G conveyed by the document conveying device 52 in a state where the document reading device 56 is stationary on the left end portion of the platen glass 54 and to read the reading document G placed on the platen glass 54 while the document reading device 56 moves in the horizontal direction.

Moreover, in the image forming section 14 disposed on the underside of the document reading section 16, a cylindrical image holder (image holding member) 62 on whose surface toner images are formed and held is disposed in the center of the apparatus body 10A of the image forming apparatus 10. The image holder 62 is rotated in the direction of arrow +R (a clockwise direction in the drawings) by unillustrated driving means and holds an electrostatic latent image formed by irradiation with light. Further, in a position above the image holder 62 and opposing the surface of the image holder 62, there is disposed a scorotron charging member 64 that charges the surface of the image holder 62. This charging member 64 will be described in detail later.

Moreover, in a position on the downstream side of the charging member 64 in the rotating direction of the image holder 62 and opposing the surface of the image holder 62, there is disposed an exposure device 66. The exposure device 66 is configured by a light emitting diode (LED) and irradiates (exposes) the surface of the image holder 62 charged by the charging member 64 with light on the basis of image signals corresponding to toner colors to form an electrostatic latent image. The exposure device 66 is not limited to an LED and may also, for example, use a polygon mirror to scan laser light.

Further, on the downstream side of the site irradiated with the exposure light of the exposure device 66 in the rotating direction of the image holder 62, there is disposed a rotation-switching developing device 70 that develops the electrostatic latent image formed on the surface of the image holder 62 with toners of determined colors to thereby make the electrostatic latent image visible.

Figure 5:
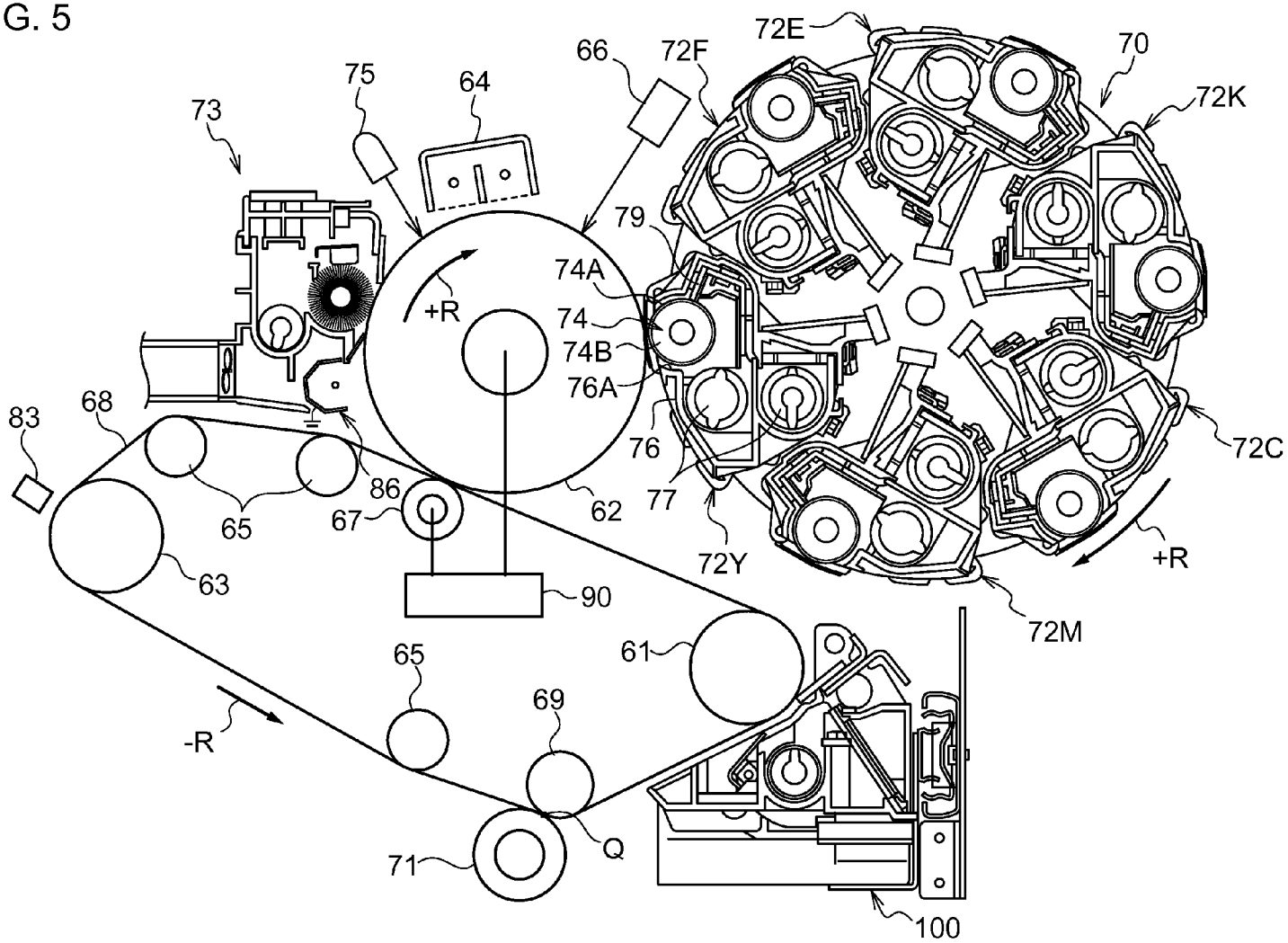
FIG. 5 is a side view showing the charging member and the like used in the cleaning system pertaining to the first exemplary embodiment of the present invention.

As shown in FIG. 5, in the developing device 70, developing units 72Y, 72M, 72C, 72K, 72E, and 72F corresponding respectively to the toner colors of yellow (Y), magenta (M), cyan (C), black (K), a first special color (E), and a second special color (F) are placed so as to be juxtaposed in a circumferential direction (in this order in a counterclockwise direction). Additionally, the developing device 70 is rotated 60° at a time at a center angle by a motor (not shown) that is rotating means, whereby the developing units 72Y, 72M, 72C, 72K, 72E, and 72F that perform development processing are switched so as to oppose the surface of the image holder 62. The developing units 72Y, 72M, 72C, 72K, 72E, and 72F have the same configuration, so here the developing unit 72Y will be described and description in regard to the other developing units 72M, 72C, 72K, 72E, and 72F will be omitted.

The developing unit 72Y has a case member 76 serving as a body, and the inside of the case member 76 is charged with a developer (not shown) including a carrier and a toner supplied via a toner supply path (not shown) from a toner cartridge 78Y (see FIG. 6), Further, a rectangular open portion 76A is formed in the case member 76 so as to oppose the surface of the image holder 62, and a developing roll 74 whose surface opposes the surface of the image holder 62 is disposed in the open portion 76A. Moreover, in a site close to the open portion 76A inside the case member 76, a tabular regulating member 79 for regulating the layer thickness of the developer is disposed along the lengthwise direction of the open portion 76A.

The developing roll 74 is configured by a cylindrical developing sleeve 74A, which is disposed so as to be rotatable, and a magnetic member 74B, which has multiple magnetic poles and is fixed to the inner side of the developing sleeve 74A. The developing sleeve 74A rotates, whereby a magnetic brush of the developer (carrier) is formed, and the layer thickness of the developer is regulated by the regulating member 79, whereby a developer layer is formed on the surface of the developing sleeve 74A. Additionally, the developer layer on the surface of the developing sleeve 74A is conveyed to a position opposing the image holder 62, and the toner corresponding to the latent image (electrostatic latent image) formed on the surface of the image holder 62 is caused to adhere to the surface of the image holder 62, whereby development is performed.

Further, inside the case member 76, two conveyance augers 77 formed in spiral shapes are placed in parallel so as to be rotatable. These two conveyance augers 77 rotate, whereby the developer with which the inside of the case member 76 is charged is circulated and conveyed in the axial direction of the developing roll 74 (in the lengthwise direction of the developing unit 72Y). The six developing rolls 74 disposed in each of the developing units 72Y, 72M, 72C, 72K, 72E, and 72F are placed in the circumferential direction such that the interval with the adjacent developing roll 74 becomes a center angle of 60° and are configured such that the next developing roll 74 opposes the surface of the image holder 62 because of the switching of the developing units 72.

Moreover, on the downstream side of the developing device 70 in the rotating direction of the image holder 62 and on the underside of the image holder 62, there is disposed an intermediate transfer belt 68 onto which the toner images formed on the surface of the image holder 62 are transferred.

This intermediate transfer belt 68 is endless and is wrapped around a drive roll 61 that is driven to rotate by the controller 20, a tension applying roll 63 for applying tension to the intermediate transfer belt 68, multiple conveyance rolls 65 that contact the undersurface of the intermediate transfer belt 68 and passively rotate, and an auxiliary roll 69 that contacts the undersurface of the intermediate transfer belt 68 and passively rotates. Additionally, the intermediate transfer belt 68 is configured to move around in the direction of arrow –R (a counterclockwise direction in the drawings) as a result of the drive roll 61 rotating.

Further, on the opposite side of the image holder 62 across the intermediate transfer belt 68, there is disposed a primary transfer roll 67 that primarily transfers the toner images formed on the surface of the image holder 62 onto the intermediate transfer belt 68. The primary transfer roll 67 contacts the undersurface of the intermediate transfer belt 68 in a position apart from, on the downstream side in the moving direction of the intermediate transfer belt 68, the position where the image holder 62 and the intermediate transfer belt 68 contact each other. Additionally, the primary transfer roll 67 is supplied with electricity from an unillustrated power source, whereby the primary transfer roll 67 primarily transfers the toner images on the image holder 62 onto the intermediate transfer belt 68 using the difference in electric potential with the grounded image holder 62.

Moreover, on the opposite side of the auxiliary roll 69 across the intermediate transfer belt 68, there is disposed a secondary transfer roll 71 that secondarily transfers the toner images primarily transferred onto the intermediate transfer belt 68 onto the sheet member P. The position between the secondary transfer roll 71 and the auxiliary roll 69 is configured to be a secondary transfer position where the toner images are transferred to the sheet member P. The secondary transfer roll 71 contacts the surface of the intermediate transfer roll 68. Additionally, the secondary transfer roll 71 is grounded and secondarily transfers the toner images on the intermediate transfer belt 68 onto the sheet member P using the difference in electrical potential between the auxiliary roll 69, to whose shaft a bias is applied from an unillustrated power source, and the grounded secondary transfer roll 71.

Further, on the opposite side of the drive roll 61 across the intermediate transfer belt 68, there is disposed a cleaning device 100 equipped with a blade 100A that scrapes off residual toner after the secondary transfer from the intermediate transfer belt 68.

Moreover, in a position opposing the tension applying roll 63 on the periphery of the intermediate transfer belt 68, there is disposed a position detection sensor 83 that detects a predetermined reference position on the intermediate transfer belt 68 by detecting a mark (not shown) applied to the surface of the intermediate transfer belt 68 and outputs a position detection signal serving as a reference for the start timing of image formation processing.

Further, on the downstream side of the primary transfer roll 67 in the rotating direction of the image holder 62, there is disposed a corotron adjusting charger 86 that charges and adjusts the charged potential of the surface of the image holder 62 to the negative side. Moreover, on the downstream side of the adjusting charger 86 in the rotating direction of the image holder 62, there is disposed a cleaning device 73 that cleans residual toner and the like remaining on the surface of the image holder 62 without being primarily transferred onto the intermediate transfer belt 68.

Further, on the downstream side of the cleaning device 73 (on the upstream side of the charging member 64) in the rotating direction of the image holder 62, there is disposed an erasing device 75 that irradiates the surface of the image holder 62 with light to perform neutralization.

As shown in FIG. 6, the secondary transfer position of the toner images resulting from the secondary transfer roll 71 is set midway along the aforementioned conveyance path 28. Additionally, on the downstream side of the secondary transfer roll 71 in the conveyance direction of the sheet member P in the conveyance path 28 (in the direction of arrow A in FIG. 6), there is disposed a fixing device 80 that fixes the toner images to the sheet member P to which the toner images have been transferred by the secondary transfer roll 71.

The fixing device 80 is configured by a heat roll 82, which is placed on the toner image surface side (upper side) of the sheet member P and has a heat source that emits heat as a result of being supplied with electricity, and a pressure roll 84, which is placed on the underside of the heat roll 82 and pressures the sheet member P towards the surface of the heat roll 82. On the downstream side of the fixing device 80 in the conveyance direction of the sheet member P in the conveyance path 28, there are disposed conveyance rolls 39 that convey the sheet member P towards the paper discharge unit 15 or the inversion portion 33.

On the upstream side of the developing device 70 on the underside of the document reading device 56, toner cartridges 78Y, 78M, 78C, 78K, 78E, and 78F that house the toners of yellow (Y), magenta (M), cyan (C), black (K), the first special color (E), and the second special color (F) are juxtaposed in the horizontal direction and disposed so as to be replaceable. The first special color E and the second special color F are configured such that they are selected or not selected from special colors (including transparent) other than yellow, magenta, cyan, and black. Additionally, the developing device 70 is configured such that, when the first special color E and the second special color F have been selected, it performs image formation in the six colors of Y, M, C, K, E, and F and such that, when the first special color E and the second special color F are not selected, it performs image formation in the four colors of Y, M, C, and K. In the present exemplary embodiment, as one example, a case where the developing device 70 performs image formation in the four colors of Y, M, C, and K and does not use the first special color E and the second special color F will be described; however, as another example, the developing device 70 may also perform image formation in five colors using the four colors of Y, M, C, and K and either the first special color E or the second special color F.

According to the above configuration, as shown in FIG. 6, when the image forming apparatus 10 is put into operation, image data of each color of yellow (Y), magenta (M), cyan (C), and black (K) are sequentially outputted from an image processing device (not shown) or the outside. At this time, as one example, the developing device 70 rotates and is held such that the developing unit 72Y (see FIG. 5) opposes the surface of the image holder 62. Further, the blade 100A of the cleaning device 100 and the secondary transfer roll 71 are away from the surface of the intermediate transfer belt 68 until the toner images of each color are multiply (primarily) transferred onto the intermediate transfer belt 68.

Next, the surface of the image holder 62 that has been charged by the charging member 64 is exposed to light that has been emitted from the exposure device 66 according to the image data. Then, for example, an electrostatic latent image corresponding to the yellow image data is formed on the surface of the image holder 62. Moreover, the electrostatic latent image that has been formed on the surface of the image holder 62 is developed as a yellow toner image by the developing unit 72Y. Then, the yellow toner image on the surface of the image holder 62 is transferred onto the intermediate transfer belt 68 by the primary transfer roll 67.

Next, the developing device 70 is rotated 60° in the direction of arrow +R such that the developing unit 72M opposes the surface of the image holder 62. Then, each step of charging, exposure, and development is performed, and the magenta toner image on the surface of the image holder 62 is transferred onto the yellow toner image on the intermediate transfer belt 68 by the primary transfer roll 67. Similarly, the cyan (C) and black (K) toner images are sequentially multiply transferred onto the intermediate transfer belt 68. When transfer of the toner images with respect to the intermediate transfer belt 68 ends, the blade 100A of the cleaning device 100 and the secondary transfer roll 71 contact the surface of the intermediate transfer belt 68.

Meanwhile, the sheet member P that has been fed from the housing section 12 and conveyed on the conveyance path 28 is conveyed by the alignment rolls 38 to the secondary transfer position at a timing matching the multiple transfer of each toner image to the intermediate transfer belt 68. Then, the toner images that have been multiply transferred onto the intermediate transfer belt 68 are secondarily transferred by the secondary transfer roll 71 onto the sheet member P that has been conveyed to the secondary transfer position. Moreover, the residual toner adhering to the surface of the intermediate transfer belt 68 is scraped off of the intermediate transfer belt 68 and is recovered by the blade 100A.

Next, the sheet member P to which the toner images have been transferred is conveyed in the direction of arrow A (the right direction in FIG. 6) towards the fixing device 80. Then, in the fixing device 80, the toner images are subjected to heat and pressure by the heat roll 82 and the pressure roll 84, whereby the toner images are fixed to the sheet member P. Moreover, the sheet member P to which the toner images have been fixed is discharged to the paper discharge unit 15 as one example. When images are to be formed on both sides of the sheet member P, image fixing is performed on the front side of the sheet member P by the fixing device 80, and thereafter the sheet member P is sent into the inversion portion 30 along the direction of arrow −V and is sent out along the direction of arrow +V, whereby the trailing edge is interchanged with the leading edge of the sheet member P. Then, the sheet member P is conveyed in the direction of arrow B (the left direction in FIG. 6) by the two-sided conveyance path 29, is sent into the conveyance path 28, and image formation and fixing on the back side of the sheet member P are performed in the same manner as on the front side.

(Configurations of Relevant Portions)

Next, the charging member 64 will be described.

Figure 1:
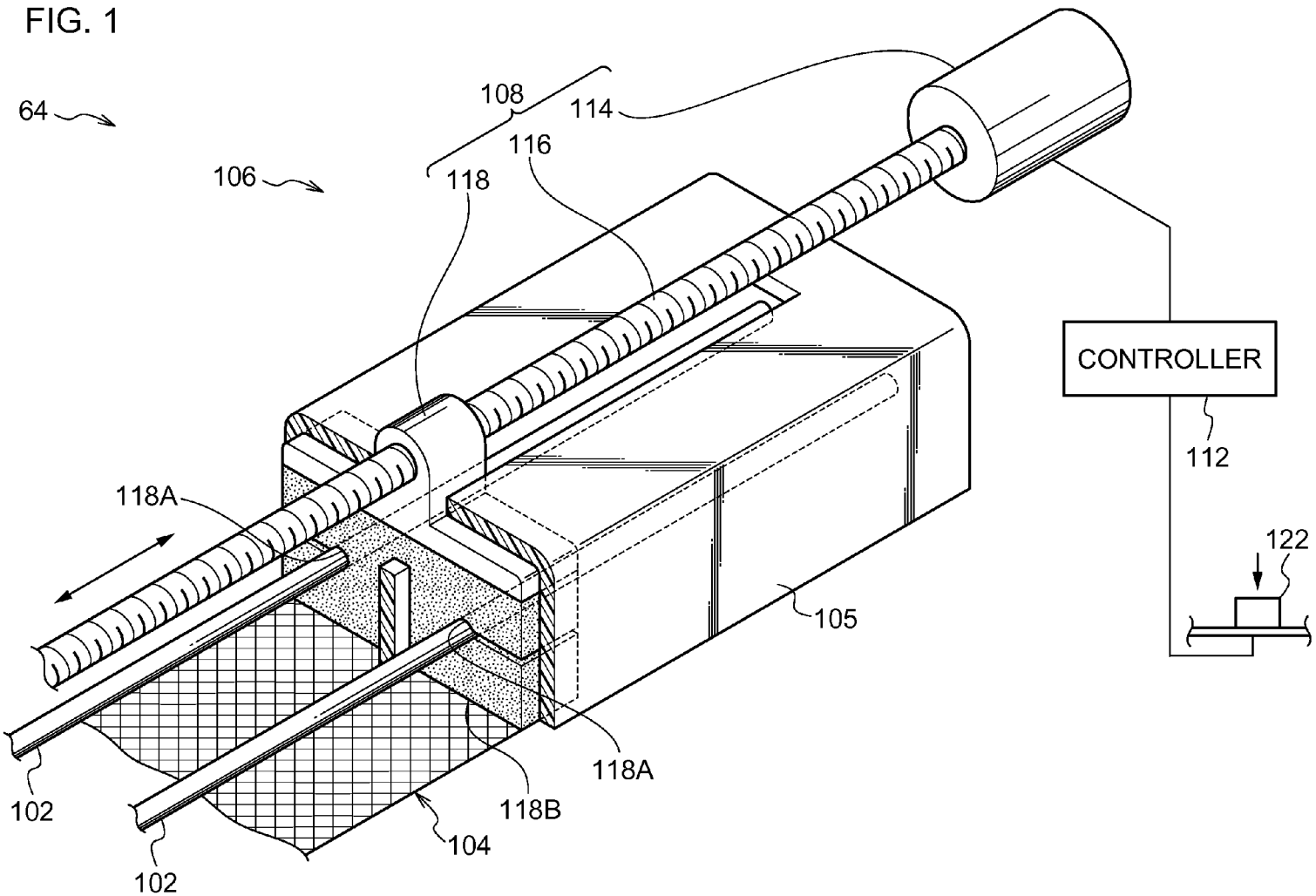
FIG. 1 is a perspective view showing a cleaning system pertaining to a first exemplary embodiment of the present invention.
Figure 4:
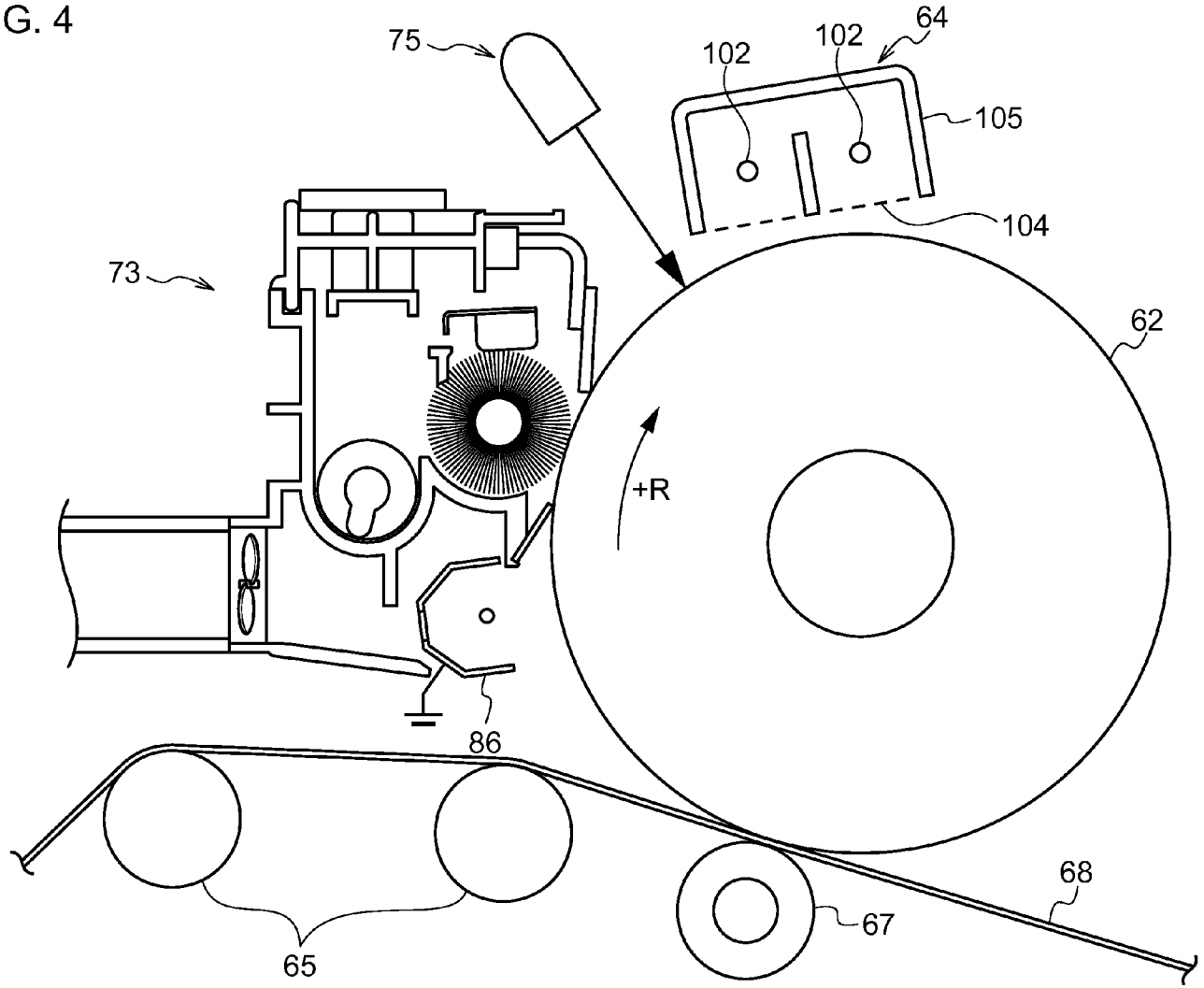
FIG. 4 is a side view showing a charging member and the like used in the cleaning system pertaining to the first exemplary embodiment of the present invention.

As shown in FIG. 4, the charging member 64 is configured to include two discharge wires 102 serving as discharge electrodes, a box-like casing 105 that is equipped with the discharge wires 102 inside, and a mesh metal plate grid 104 that is disposed so as to cover an opening in the casing 105. Moreover, as shown in FIG. 1, in the charging member 64, there is disposed a cleaning system 106 that cleans the discharge wires 102 and the grid 104.

Specifically, this cleaning system 106 is configured to include a cleaning device 108 serving as one example of a maintenance device and a controller 112 that controls the activation of this cleaning device 108. Additionally, in this cleaning device 108, there are disposed a stepping motor 114 that is rotated by the control of the controller 112, a threaded shaft member 116 to which the motive force of this stepping motor 114 is transmitted, and a moving member 118 into which this shaft member 116 is screwed and which moves inside the casing 105 as a result of the shaft member 116 rotationally moving.

Further, this moving member 118 is equipped with wire cleaning portions 118A, which sandwich and clean the discharge wires 102, and a grid cleaning portion 118B, which contacts and cleans the grid 104.

Cumulative image density, image holder number-of-rotations, cumulative number of prints (number of sheets on which image formation has been performed), charging time, and sitting time, which serve as one example of numerical values associated with the operation of the maintenance target device, are fed into the controller 112.

Additionally, as shown in FIG. 3, threshold values for putting the cleaning device 108 into operation are respectively preset in regard to the cumulative image density, the image holder number-of-rotations, the cumulative number of prints, the charging time, and the sitting time. In the present exemplary embodiment, in order to facilitate understanding, the threshold values that have been preset with respect to the respective parameters (hereinafter called "initial threshold values") will be described as being 1000. Additionally, the cleaning system 106 is configured such that when any of the parameters has reached its threshold value, the controller 112 activates the cleaning device 108 so as to clean the discharge wires 102 and the grid 104. The cleaning system 106 is also configured such that the count of that parameter is reset when the cleaning device 108 is activated.

Further, as shown in FIG. 1, in this cleaning system 106, there is disposed an instruction button 122 that the user presses to instruct the controller 112 to activate the cleaning device 108 when, for example, the user feels that the quality of the output images has dropped when looking at the output images. That is, the cleaning system 106 is configured such that the cleaning device 108 is activated by an instruction from the user even when none of the parameters have reached their threshold values.

According to the above configuration, when the cleaning device 108 is activated by an instruction from the controller 112, the stepping motor 114 rotates one way or the other, whereby the shaft member 116 rotates one way or the other such that the moving member 118 reciprocally moves inside the casing 105. Additionally, the discharge wires 102 and the grid 104 are cleaned as a result of the moving member 118 reciprocally moving inside the casing 105.

Further, the controller 112 is configured to change the threshold values of each parameter in a predetermined range (e.g., 800 to 1000) when the cleaning device 108 has been activated by an instruction from the user.

Moreover, the controller 112 is configured to change the threshold values of each parameter towards the initial threshold values when the cleaning device 108 has been activated consecutively multiple times (e.g., 5 times) without an instruction from the user after the preset threshold values (in the present exemplary embodiment, 1000) have been changed.

The configuration of the controller 112 will be described in detail together with the action.

(Action)

Next, the action of the cleaning system 106, that is, the control by the controller 112 of the operation of the cleaning device 108 and the changing of the threshold values, will be described on the basis of the flowchart of FIG. 2.

First, in step 100, the controller 112 recognizes a command to activate the cleaning device 108. Then, the controller 112 moves to step 200.

In step 200, when the controller 112 judges that it is being instructed to activate the cleaning device 108 as a result of the user having pressed the instruction button 122, it moves to step 300, and when the controller 112 judges that it is being instructed to activate the cleaning device 108 as a result of any of the parameters having reached its threshold value, it moves to step 400.

In step 300, the controller 112 judges whether or not the instruction from the user within a predetermined amount of time exceeds a determined number of times.

Specifically, the controller 112 judges whether or not the number of times an instruction has been given by the user (the number of times the user has pressed the instruction button 122) within a predetermined amount of time (e.g., 1 hour) exceeds a determined number of times (e.g., 5 times). When the controller 112 judges that the number of times an instruction has been given by the user within the predetermined amount of time exceeds the determined number of times (is equal to or greater than 6 times), it moves to step 500.

In step 500, the controller 112 invalidates the instruction to activate the cleaning device 108 and maintains the threshold values of each parameter as is (no change).

On the other hand, in step 300, when the controller 112 judges that the number of times an instruction has been given by the user within the predetermined amount of time (e.g., 1 hour) does not exceed the determined number of times (e.g., 5 times) (is equal to or less than 5 times), it moves to step 600.

In step 600, the controller 112 judges whether or not the threshold values will deviate from their predetermined ranges (e.g., 800 to 1000) if it changes the threshold values of each parameter (reduces the threshold values of each parameter by 10% as described later). When the controller 112 judges that the threshold values will deviate from their predetermined ranges, it moves to step 700.

In step 700, the controller 112 validates the instruction to activate the cleaning device 108 and activates the cleaning device 108. Moreover, the controller 112 maintains the threshold values of each parameter as is (no change).

On the other hand, in step 600, when the controller 112 judges that the threshold values will not deviate from their predetermined threshold value ranges (e.g., 800 to 1000) even if it changes the threshold values of each parameter, it moves to step 800.

When the controller 112 judges that the threshold values will not deviate from their predetermined ranges if it changes the threshold values by 10%, it moves to step 800; however, the controller 112 may also be configured such that when the threshold values will fall below their lower limit values (800) if it changes the threshold values by 10%, it changes the threshold values by 7%, for example, so that the threshold values become the lower limit values (800) and then moves to step 800.

In step 800, the controller 112 validates the instruction to activate the cleaning device 108 and activates the cleaning device 108. Moreover, the controller 112 changes the threshold values of each parameter across the board. Specifically, as shown in FIG. 3, the controller 112 reduces the threshold values of each parameter by 10%.

That is, it is presumed that the user has pressed the instruction button 122 to activate the cleaning device 108 because the threshold values are large (long) as compared to threshold values for activation intervals meeting the demand of the user with respect to image quality. That being the case, considering the current usage and the satisfaction of the user, it is necessary to reduce (shorten) the threshold values because the threshold values are large (long). Thus, the controller 112 reduces the threshold values of each parameter by 10%.

In this manner, the controller 112 reduces the threshold values and returns. After step 500 and after step 700 also, the controller 112 similarly returns.

Figure 2:
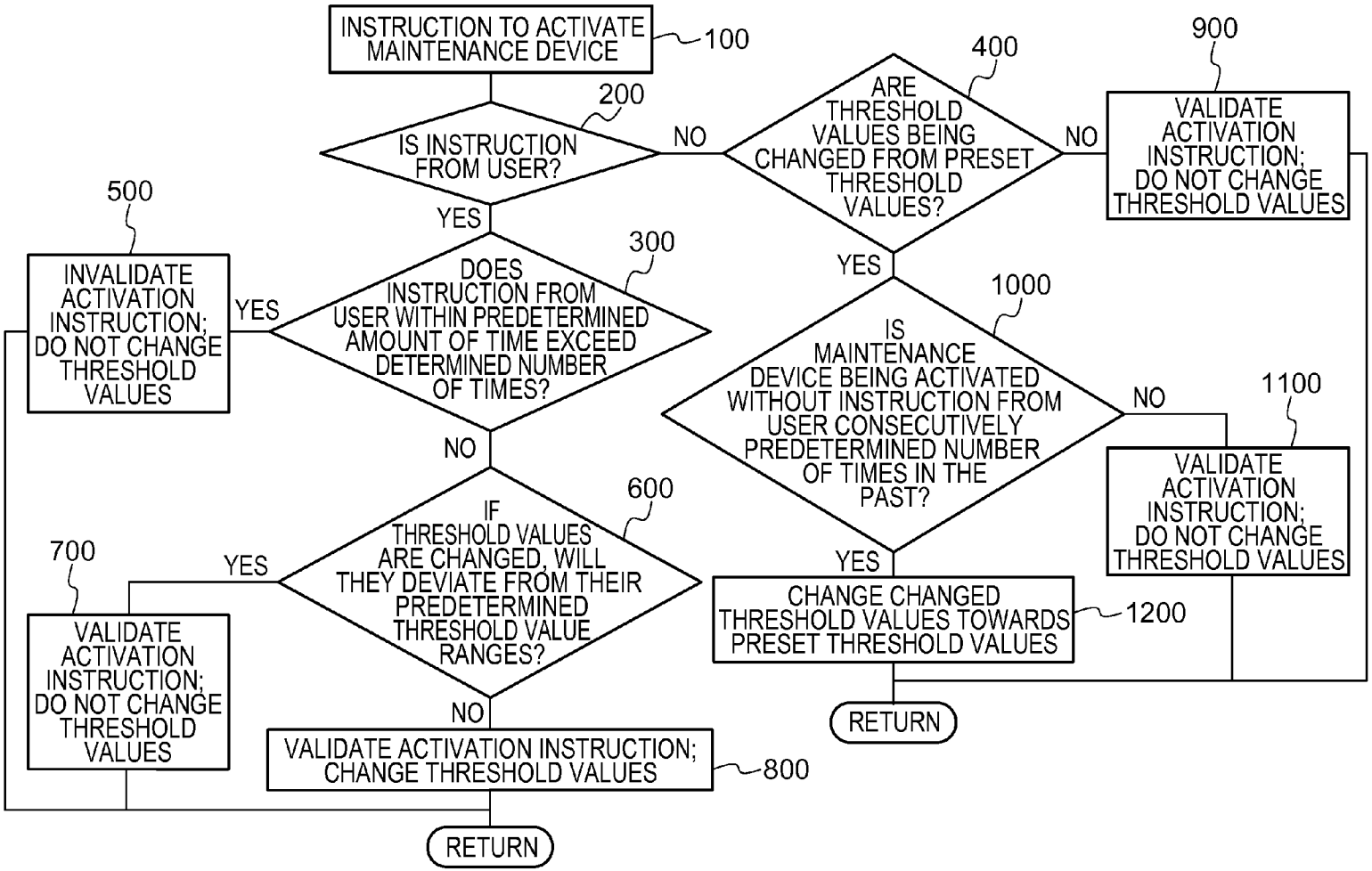
FIG. 2 is a flowchart showing a control flow of a controller used in the cleaning system pertaining to the first exemplary embodiment of the present invention.

In contrast, as shown in FIG. 2, in step 200, when the controller 112 has been instructed to activate the cleaning device 108 as a result of any of the parameters having reached its threshold value and has moved to step 400, then in step 400, the controller 112 judges whether or not the threshold values are being changed from the initial threshold values. When the controller 112 judges that the initial threshold values are not being changed, it moves to step 900.

In step 900, the controller 112 validates the instruction to activate the cleaning device 108 and activates the cleaning device 108. Moreover, the controller 112 maintains the threshold values of each parameter as is (no change).

On the other hand, in step 400, when the controller 112 judges that the threshold values are being changed from the initial threshold values, it moves to step 1000.

In step 1000, the controller 112 judges whether or not the cleaning device 108 is being activated, without an instruction from the user, consecutively a predetermined number of times (e.g., 3 times) in the past. When the controller 112 judges that the cleaning device 108 is not being activated consecutively the predetermined number of times (equal to or less than 2 times), it moves to step 1100.

In step 1100, the controller 112 validates the instruction to activate the cleaning device 108 and activates the cleaning device 108. Moreover, the controller 112 maintains the threshold values of each parameter as is (no change).

On the other hand, in step 1000, when the controller 112 judges that the cleaning device 108 is being activated consecutively the predetermined number of times (equal to or greater than 3 times), it moves to step 1200.

In step 1200, the controller 112 validates the instruction to activate the cleaning device 108 and activates the cleaning device 108. Moreover, the controller 112 changes the changed threshold values towards the initial threshold values.

In this manner, the controller 112 changes the changed threshold values towards the initial threshold values and returns. After step 900 and after step 1100 also, the controller 112 similarly returns.

As described above, the threshold values for activating the cleaning device 108 are changed depending on the usage. Additionally, because the threshold values are changed in this manner, the number of times the cleaning device 108 is activated can be changed depending on the situation of forced activation in a configuration having forced activation and automatic activation.

Further, because the controller 112 changes the multiple threshold values across the board in step 800, the threshold values are changed by a simple method.

Further, when the number of times an instruction has been given by the user within the predetermined amount of time exceeds the determined number of times, the controller 112 invalidates the instruction to activate the cleaning device 108 in step 500. In this manner, the controller 112 does not activate the cleaning device 108 when it judges that activation is unnecessary.

Further, in changing the threshold values, when the threshold values will deviate from their predetermined threshold value ranges, the controller 112 maintains the threshold values of each parameter as is in step 700 (no change). In this manner, excessive activation is controlled by changing the threshold values within their predetermined threshold value ranges.

Further, when the cleaning device 108 has been activated, without an instruction from the user, consecutively a predetermined number of times in the past, then in step 1200, the controller 112 changes the changed threshold values towards the initial threshold values. That is, it is presumed that the threshold values are large (long) as compared to threshold values for activation intervals meeting the demand of the user with respect to image quality, so by returning the threshold values to the initial threshold values, the cleaning device is efficiently activated.

Further, because the cleaning device is efficiently activated depending on the usage, the quality of the output images improves.

Next, a cleaning system and an image forming apparatus of a second exemplary embodiment of the present invention will be described in accordance with FIG. 7 and FIG. 8. Members that are the same as those in the first exemplary embodiment will be denoted by the same reference numerals and description thereof will be omitted.

Figure 7:
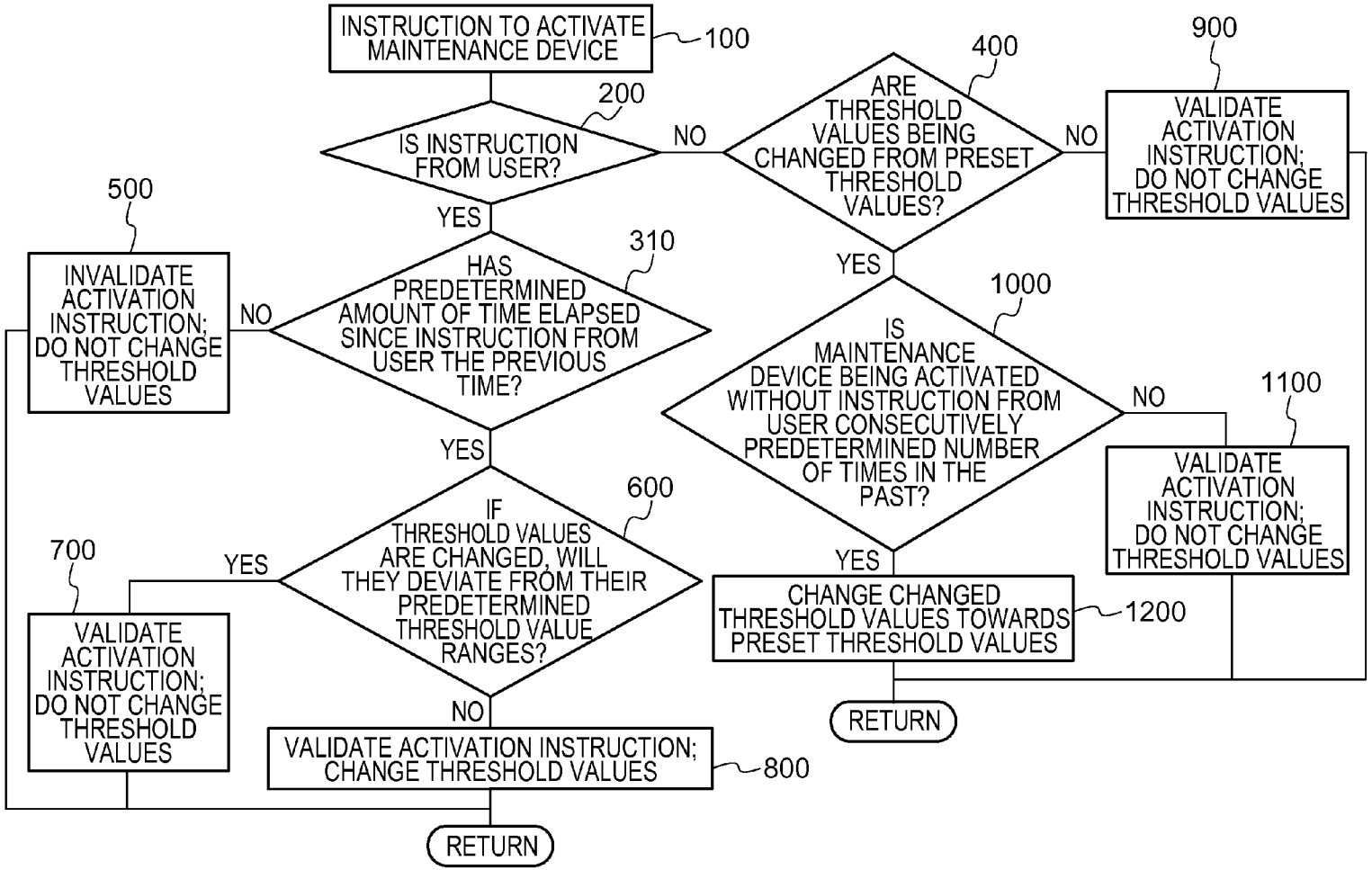
FIG. 7 is a flowchart showing a control flow of a controller used in a cleaning system pertaining to a second exemplary embodiment of the present invention.

As shown in FIG. 7, in step 200, when the controller 112 judges that it is being instructed to activate the cleaning device 108 as a result of the user having pressed the instruction button 122, it moves to step 310.

In step 310, the controller 112 judges whether the instruction to activate the cleaning device 108 from the user again is consecutive without the cleaning device 108 being automatically activated after the user has activated the cleaning device 108 a previous time and judges whether or not a predetermined amount of time (e.g., 1 hour) has elapsed since the instruction from the user the previous time.

That is, the controller 112 judges whether or not the amount of time between when the user pressed the instruction button 122 the previous time and when the user pressed the instruction button 122 this time exceeds the predetermined amount of time (e.g., 1 hour). When the controller 112 judges that the determined amount of time has not elapsed, it moves to step 500 and invalidates the instruction to activate the cleaning device 108. Further, when the controller 112 judges that the determined amount of time has elapsed, it moves to step 600.

In this manner, by invalidating the instruction to activate the cleaning device 108 when the controller 112 judges that the determined amount of time has not elapsed, activation of the cleaning device 108 that has been judged unnecessary is invalidated, and the cleaning device 108 is efficiently activated.

Further, as shown in FIG. 8, in step 800, when the controller 112 changes the threshold values of each parameter, it does not change the threshold values across the board but rather individually changes, on the basis of the activation history of the cleaning device 108, the threshold values disposed for each of the multiple parameters.

For example, in the present exemplary embodiment, the threshold value set for the cumulative image density has been reached 5 times in the past, and the threshold value set for the image holder number-of-rotations has been reached 2 times in the past. Moreover, the threshold values set for the cumulative number of prints, the charging time, and the sitting time have each been reached 1 time in the past.

Thus, the controller 112 increases the rate of change of the threshold values that have been reached many times. For example, the total number of times the threshold values have been reached is 10 times, and the threshold value set for the cumulative image density accounts for 5 of those times. When the controller 112 is configured to change the threshold values by 10%, the controller 112 changes a quantity corresponding to 5/10 of 10% in regard to the threshold value set for the cumulative image density, changes a quantity corresponding to 2/10 of 10% in regard to the threshold value set for the image holder number-of-rotations, and changes quantities corresponding to 1/10 of 10% in regard to the threshold values set for the cumulative number of prints, the charging time, and the sitting time.

Thus, the threshold value set for the cumulative image density becomes 950, the threshold value set for the image holder number-of-rotations becomes 980, and the threshold values set for the cumulative number of prints, the charging time, and the sitting time become 990.

In this manner, by individually changing, on the basis of the activation history of the cleaning device 108, the threshold values disposed for each of the multiple parameters, the threshold values are finely changed depending on the usage.

Next, a cleaning system and an image forming apparatus of a third exemplary embodiment of the present invention will be described in accordance with FIG. 9. Members that are the same as those in the first exemplary embodiment will be denoted by the same reference numerals and description thereof will be omitted.

As shown in FIG. 9, in step 800, when the controller 112 changes the threshold values of each parameter, it does not change the threshold values across the board but rather individually changes, on the basis of the activation history of the cleaning device 108, the threshold values disposed for each of the multiple parameters.

For example, in the present exemplary embodiment, the threshold value set for the cumulative image density has been reached 5 times in the past, and the threshold value set for the image holder number-of-rotations has been reached 2 times in the past. Moreover, the threshold values set for the cumulative number of prints, the charging time, and the sitting time have each been reached 1 time in the past.

Thus, the controller 112 changes the top two threshold values that have been reached many times. Specifically, the controller 112 reduces by 10% across the board the threshold value set for the cumulative image density and the threshold value set for the image holder number-of-rotations across the board, so that these two threshold values become 900.

In this manner, by individually changing, on the basis of the activation history of the cleaning device 108, the threshold values disposed for each of the multiple parameters, the threshold values are finely changed depending on the usage.

The present invention has been described in detail in regard to particular exemplary embodiments, but the present invention is not intended to be limited to these exemplary embodiments, and it will be apparent to those skilled in the art that various other embodiments may be made within the scope of the present invention. For example, in the exemplary embodiments described above, although it is not particularly limited, in step 1200, when the controller 112 changes the changed threshold values towards the initial threshold values, the controller 112 may also change the changed threshold values towards the initial threshold values in stages or may also change the changed threshold values to the initial threshold in one go.

Further, in the exemplary embodiments described above, maintenance of the image forming apparatus is performed as a result of the controller 112 activating the cleaning device 108 to clean the charging member 64, but the maintenance of the image forming apparatus is not particularly limited to cleaning a charging member and can be used in various cleaning devices and the like. For example, maintenance of the image forming apparatus may also be performed by cleaning (blowing out) old developer retained inside the developing device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A maintenance system comprising:

a maintenance device; and a control device that controls the operation of the maintenance device, wherein the control device is configured to activate the maintenance device automatically when a numerical value associated with the operation of a maintenance target device reaches a predetermined threshold value and to activate the maintenance device when it receives an instruction from a user, wherein when the control device is instructed to activate the maintenance device by an instruction from the user, the control device changes the preset threshold value such that the operation interval of the maintenance device becomes smaller.

2. The maintenance system according to claim 1, wherein multiple numerical values associated with the operation of the maintenance target device are set, the threshold value is disposed for each of the numerical values associated with the operation of the maintenance target device, and when the control device is instructed to activate the maintenance device by an instruction from the user, the control device changes across the board the threshold values corresponding to the numerical values associated with the operation of the maintenance target device.

3. The maintenance system according to claim 1, wherein multiple numerical values associated with the operation of the maintenance target device are set, the threshold value is disposed for each of the numerical values associated with the operation of the maintenance target device, and when the control device is instructed to activate the maintenance device by an instruction from the user, the control device individually changes, based on activation history of the maintenance device, the threshold values corresponding to the numerical values associated with the operation of the maintenance target device.

4. The maintenance system according to claim 1, wherein when an instruction to activate the maintenance device from the user is given multiple times within a predetermined amount of time and a number of times the instruction has been given exceeds a determined number of times, the control device invalidates the instruction after the determined number of times has been exceeded.

5. The maintenance system according to claim 1, wherein in a case in which instructions to activate the maintenance device from the user are consecutive, and a predetermined amount of time has not elapsed since the maintenance device was activated by an instruction from the user a previous time, the control device invalidates the instruction from the user.

6. The maintenance system according to claim 1, wherein the control device changes the threshold values in predetermined ranges.

7. The maintenance system according to claim 1, wherein in a case in which the maintenance device has been activated a predetermined number of times, when the preset threshold values are being changed, the control device changes the changed threshold values towards the preset threshold values.

8. The maintenance system according to claim 1, wherein the maintenance target device includes a charging member.

9. A cleaning system comprising the maintenance device of claim 1, wherein the maintenance device includes a cleaning device.

10. An image forming apparatus comprising:

an image holder on whose surface a toner image is formed;

a charging member that charges the surface of the image holder; and the maintenance system according to claim 1 which maintains the function of the charging member.

* * * * *